United States Patent [19]

Stairs, Jr.

[11] Patent Number: 4,712,256

[45] Date of Patent: Dec. 15, 1987

[54] COVER PLATE AND MOUNTING CLIP ASSEMBLY

[75] Inventor: Henry M. Stairs, Jr., Neshanic, N.J.

[73] Assignee: American Standard Inc., New York, N.Y.

[21] Appl. No.: 835,820

[22] Filed: Mar. 3, 1986

[51] Int. Cl.[4] ..... E03D 11/00

[52] U.S. Cl. ..... 4/661; 4/252 R; 4/420; 292/17; 220/326; 411/508

[58] Field of Search ..... 4/661, 252 R, 420, 255; 292/17, DIG. 11, DIG. 61; 24/682, 683; 411/339, 508, 509, 510; 174/67; 220/326

[56] References Cited

U.S. PATENT DOCUMENTS

| | | | |
|---|---|---|---|
| 1,732,940 | 10/1929 | Larson | 292/17 X |
| 1,917,186 | 7/1933 | Carlson | 292/17 X |
| 3,148,433 | 9/1964 | Carriker | 411/508 X |
| 3,214,878 | 11/1965 | Duffy et al. | 411/510 |
| 3,680,154 | 8/1972 | Stairs | 4/252 R |
| 3,916,756 | 11/1975 | Yoda | 292/DIG. 11 |
| 3,939,756 | 2/1976 | Koscik | 411/508 X |

*Primary Examiner*—Charles E. Phillips

*Attorney, Agent, or Firm*—James J. Salerno, Jr.; Robert G. Crooks; John P. Sinnott

[57] ABSTRACT

The invention is directed to a cover assembly to conceal the anchor bolt assembly housed in an opening in a vertical wall of a sanitary fixture. A novel clip, which is mounted to the anchor bolt, includes latching means to mount the cover plate over the opening.

5 Claims, 8 Drawing Figures

COVER PLATE AND MOUNTING CLIP ASSEMBLY

BACKGROUND OF THE INVENTION

The invention relates to a device for concealing the mounting bolts for sanitaryware fixtures and, more particularly, to a flexible cover plate and mounting clip assembly to cover a recess in a vertical wall of a sanitary fixture that houses the mounting bolts.

FIELD OF THE INVENTION

In the design of sanitaryware fixtures, for example: toilets, bidets, pedestals for lavatories and other like fixtures, a pair of passageways are positioned at each side of the mounting base of the fixture to house each mounting bolt assembly to fix the fixture to a floor or wall. A recess, generally rectangular, is formed around the anchor bolt passageway of the mounting base to house the anchor bolt assembly. The cover plate assembly includes a plate which is contoured to the finished surface of the base and fits over the recess to conceal the anchor bolt assembly from view. A retainer clip is affixed to the anchor bolt by a threaded nut which holds the retainer clip and the fixture in place. The retainer clip is formed having a pair of opposed upturned flanges which nest between a pair of spaced apart depending tabs formed on the under surface of the cover plate. Before the cover plate is positioned over the recess and mounted to the retainer clip, the portion of the bolt which extends above the clip is cut off so that the end of the bolt does not contact the cover plate. This facilitates its seating over the recess, and coupling to the retainer clip. Thereafter, the cover is pressed over the upturned flanges to nest between the depending tabs to mount the cover plate in place. In another fixture design, the anchor bolt passes through a passageway formed in the flanged base. A circular tapered disc is placed over the bolt and a nut is tightened to hold both the disc and the fixture in place. A cup-shaped cap having an internally radially extending rim is formed around its open end, is positioned over the free end of the bolt, and clips to the under surface of the disc to hold the cap in place. As indicated above, the top portion of the bolt is cut off so that the bolt will not interfere with the seating of the cap. In other cover designs, a cup-shaped cap is held in position over the mounting bolt by filling the cap with putty or like compounds and is pressed over the bolt end to hold the cap in place. This, of course, is unsatisfactory since the bolt would be covered with putty, and should any adjustments to the bolt and nut be required, the putty or compound must be removed before the adjustment can be made.

SUMMARY OF THE INVENTION

It is an object of the invention to provide a cover plate and mounting clip assembly to conceal the anchor bolt assembly housed in a recess formed in a vertical wall of a sanitary fixture and which does not require trimming the end of each mounting bolt to properly seat the cover plate over the recess.

Another object of the invention is to provide a novel retainer clip which is horizontally adjustable to facilitate alignment with plate gripping means to releasably couple the cover plate thereto.

A further object of the invention is to provide a cover plate formed of a plastic material which is flexible and, when mounted in place, is slightly deformed to coincide with the vertical wall surface of the sanitaryware fixture.

A further object of the invention is to provide an essentially flat, flexible cover plate having its outer perimeter tapered to minimize the accumulation of dust, dirt and other foreign material, and to facilitate cleaning of the fixture.

Still a further object of the invention is to provide a cover plate and mounting clip assembly which is inexpensive to manufacture and which is easily mounted and removed from the fixture.

The invention generally contemplates an assembly to conceal an opening which houses the mounting bolt assembly of a sanitary fixture. The assembly comprises a cover plate and retainer clip. The clip has a generally rectangular flat body segment, one section of which is formed of an elongated, longitudinal extending slot for receiving the shank of a threaded anchor bolt and for adjusting the clip horizontally. The other section of the clip is formed having at least three parallel, horizontally extending gripping fingers, two of which are coplanar and are in spaced apart relation. The at least other finger is offset thereform and is positioned between the two spaced apart fingers. The cover plate is formed of a flexible, deformable material having its outer surface contoured to generally coincide with the outer wall of the sanitary fixture. The cover plate includes a flange which extends horizontally away from its inner surface and is aligned with the space formed between the gripping fingers of the clip. The gripping fingers include means to releasably latch the horizontal flange so that the cover plate is held in position when inserted between the gripping fingers.

DETAILED DESCRIPTION OF THE DRAWINGS

Figure 6:
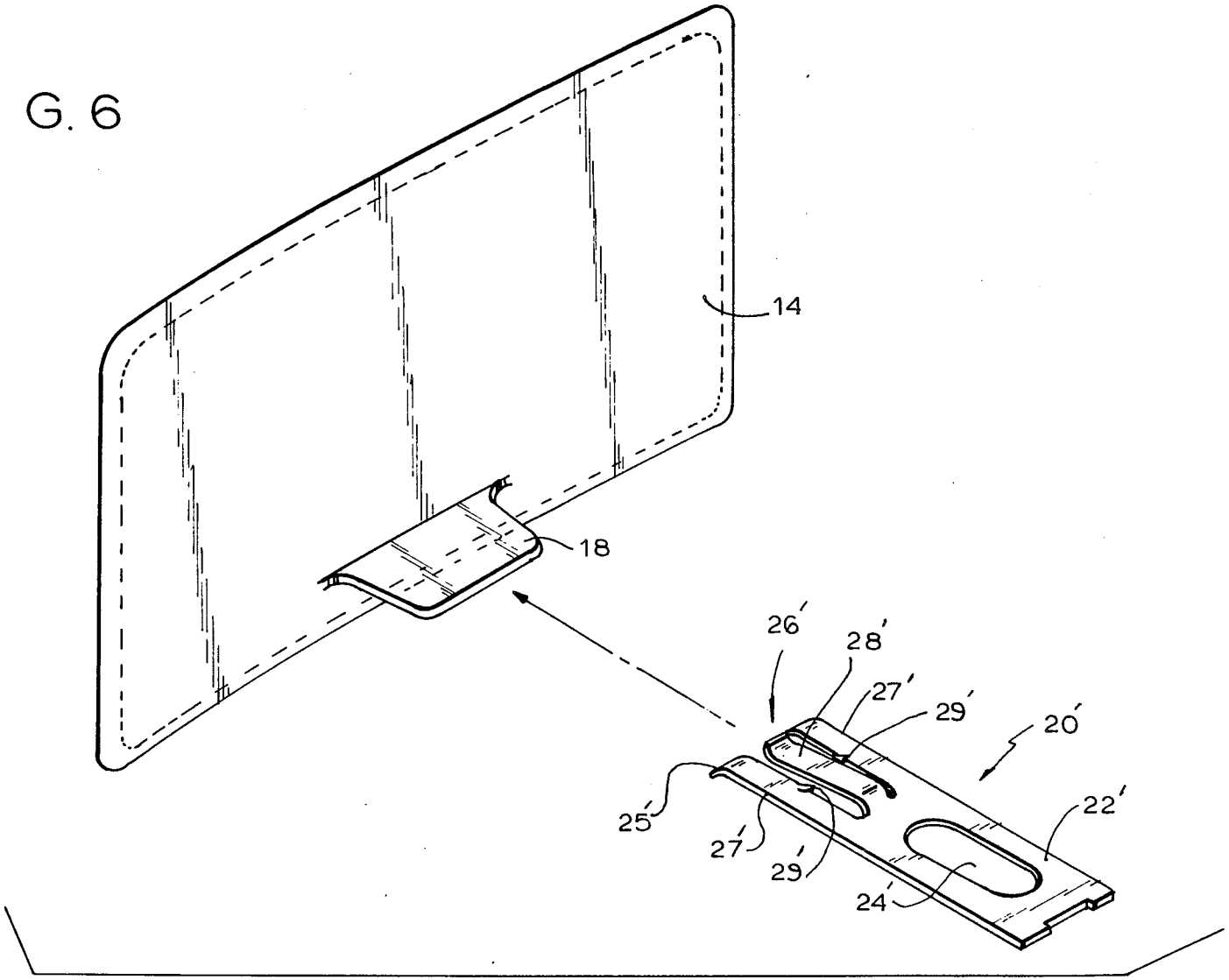
FIG. 6 is an exploded isometric view of another form of retainer clip for use with the cover plate illustrated in FIG. 3.
Figure 7:
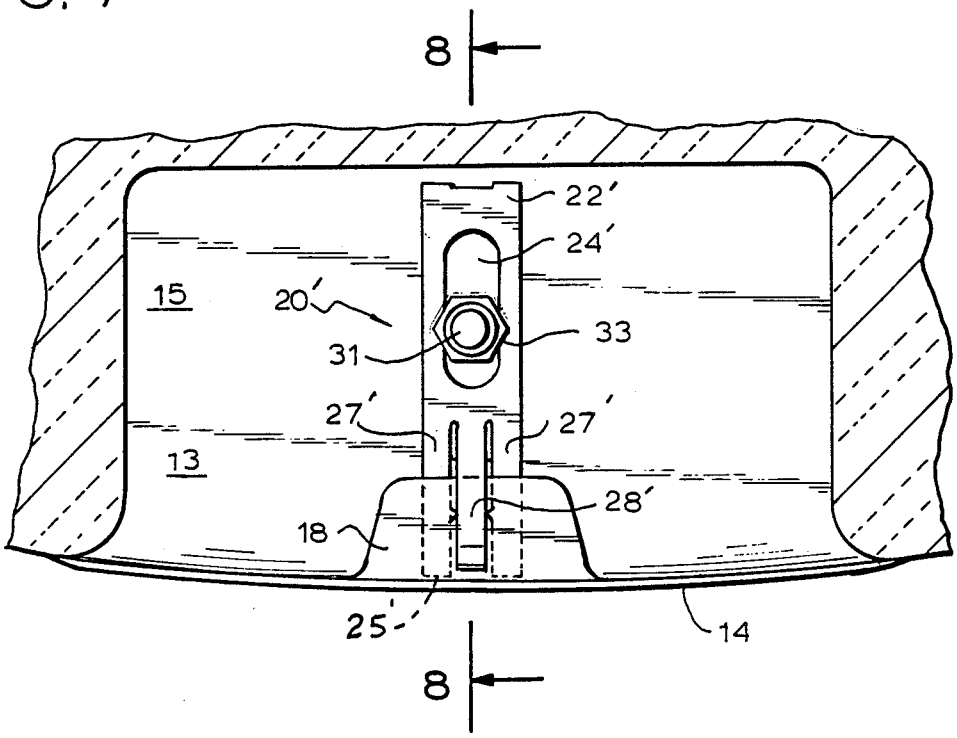
FIG. 7 is a view similar to FIG. 4 which illustrates the retainer clip and cover plate of FIG. 6 mounted in position.
Figure 8:
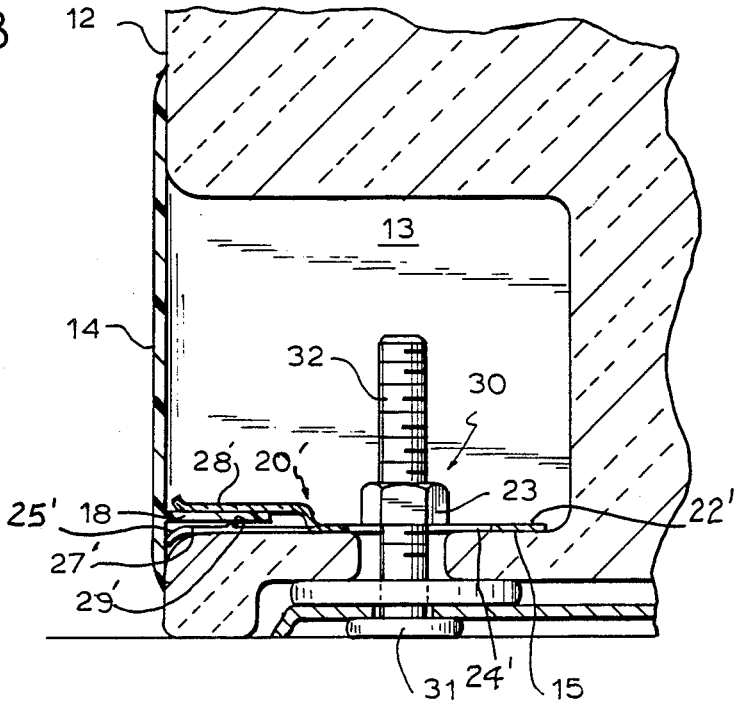
FIG. 8 is an elevational view taken along the lines 8—8 of FIG. 7.

FIGS. 1 through 5 illustrate the preferred retainer clip 20 to mount a cover plate 14 to a vertical wall 12 to conceal the opening 13 which houses the anchor bolt assembly 30 for a sanitary fixture 10 such as a toilet. FIGS. 6 through 8 illustrate another form of a retainer clip 20. Cover plate 14 includes a horizontal flange 18 which is spaced from the bottom edge 15.

Retainer clip 20 includes a generally rectangular flat body member 22, one section of which is formed having an elongated slot 24 which is positioned along the longitudinal axis of the rectangular body. Elongated slot 24 permits adjustment horizontally of retainer clip 10 within opening 13 of sanitary fixture 10. Shank 32 of mounting bolt 31 is threaded and a complimentary threaded nut 33 is tightened against retainer clip 20 shown most clearly in FIG. 5.

Figure 1:
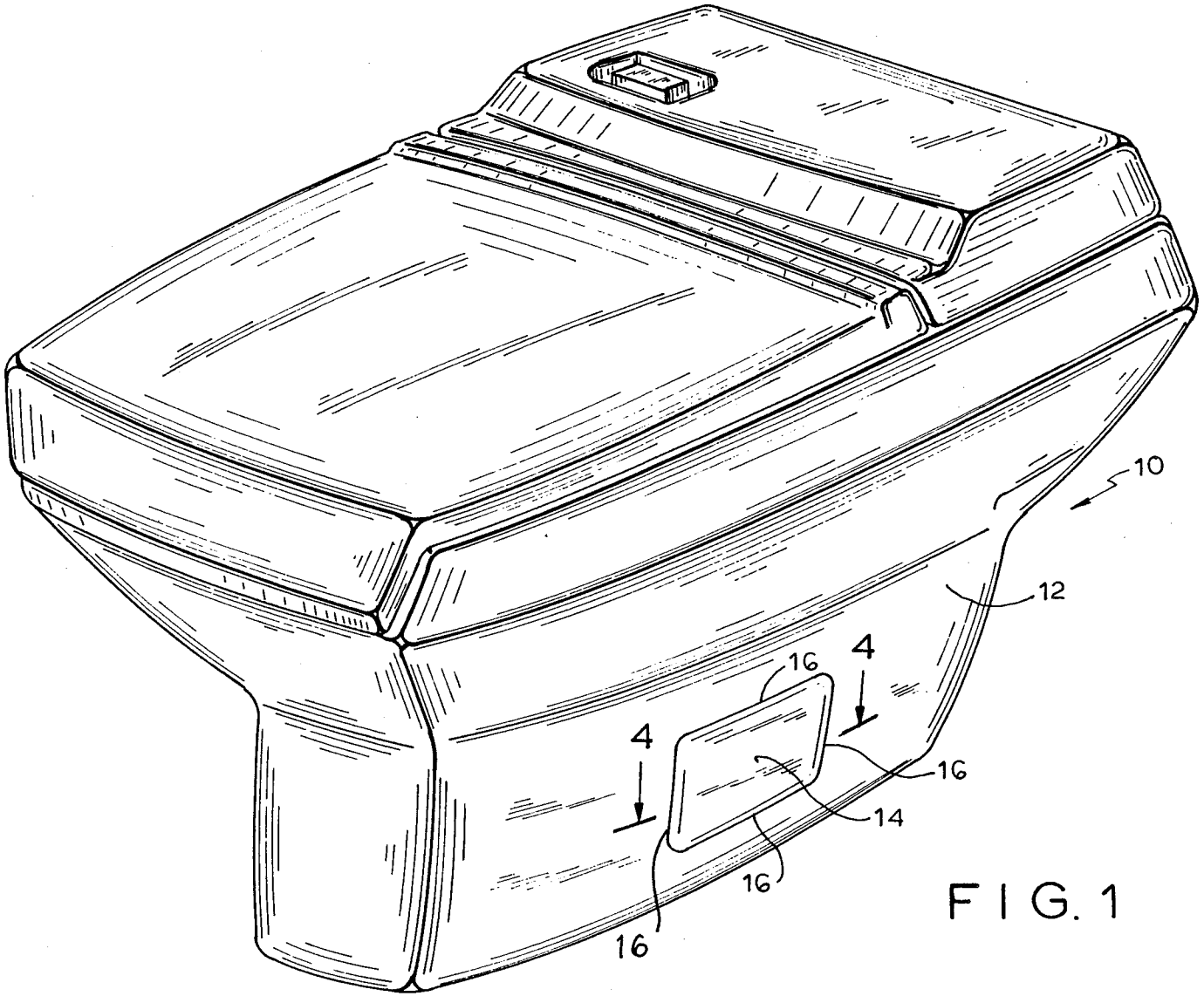
FIG. 1 is an isometric view of a toilet which illustrates the plate assembly mounted to the vertical wall opening to conceal the mounting bolt housed therein.
Figure 2:
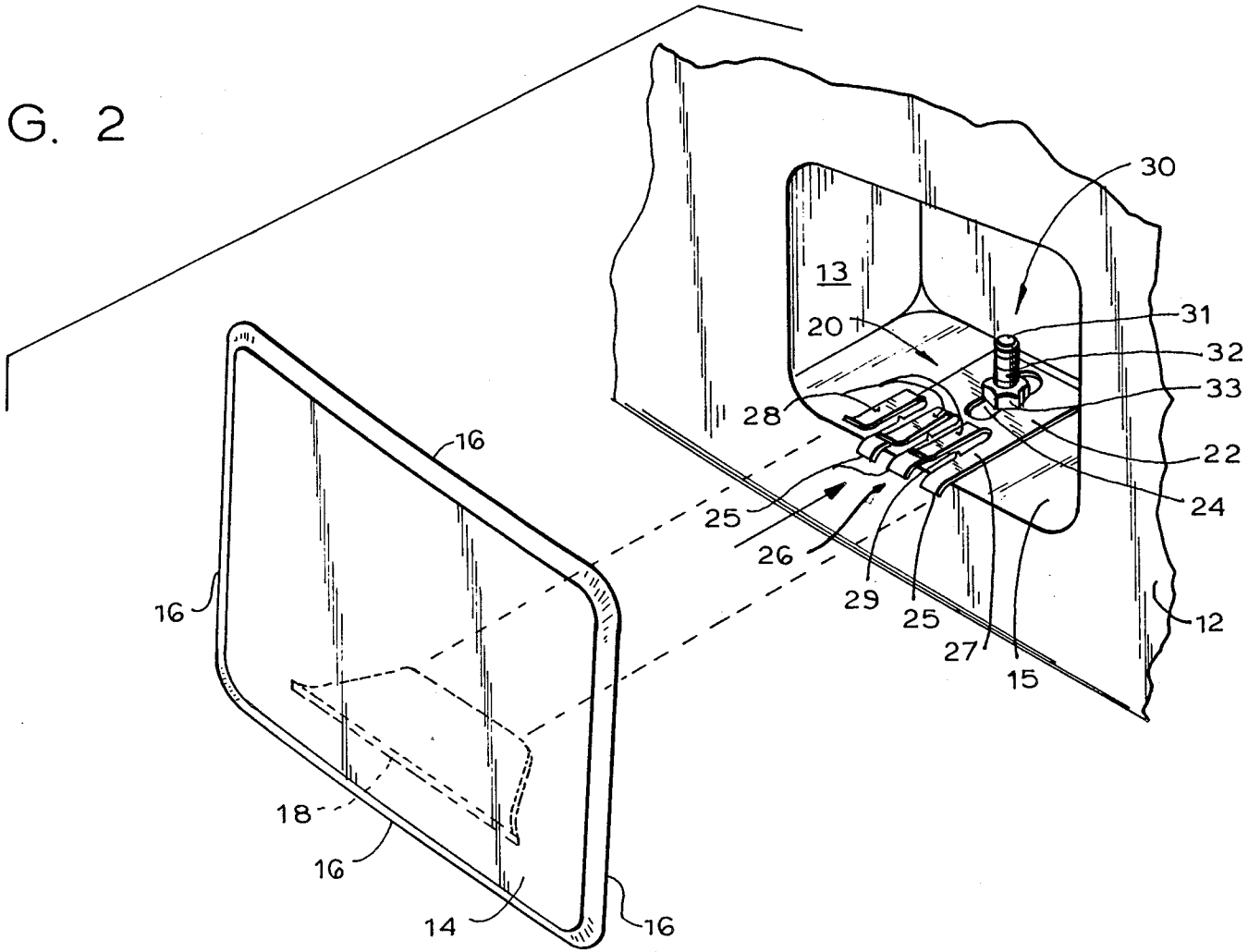
FIG. 2 is an exploded isometric view of the vertical wall section of the sanitary fixture shown in FIG. 1 and which illustrates one form of the retainer clip which mounts the cover plate in position.
Figure 3:
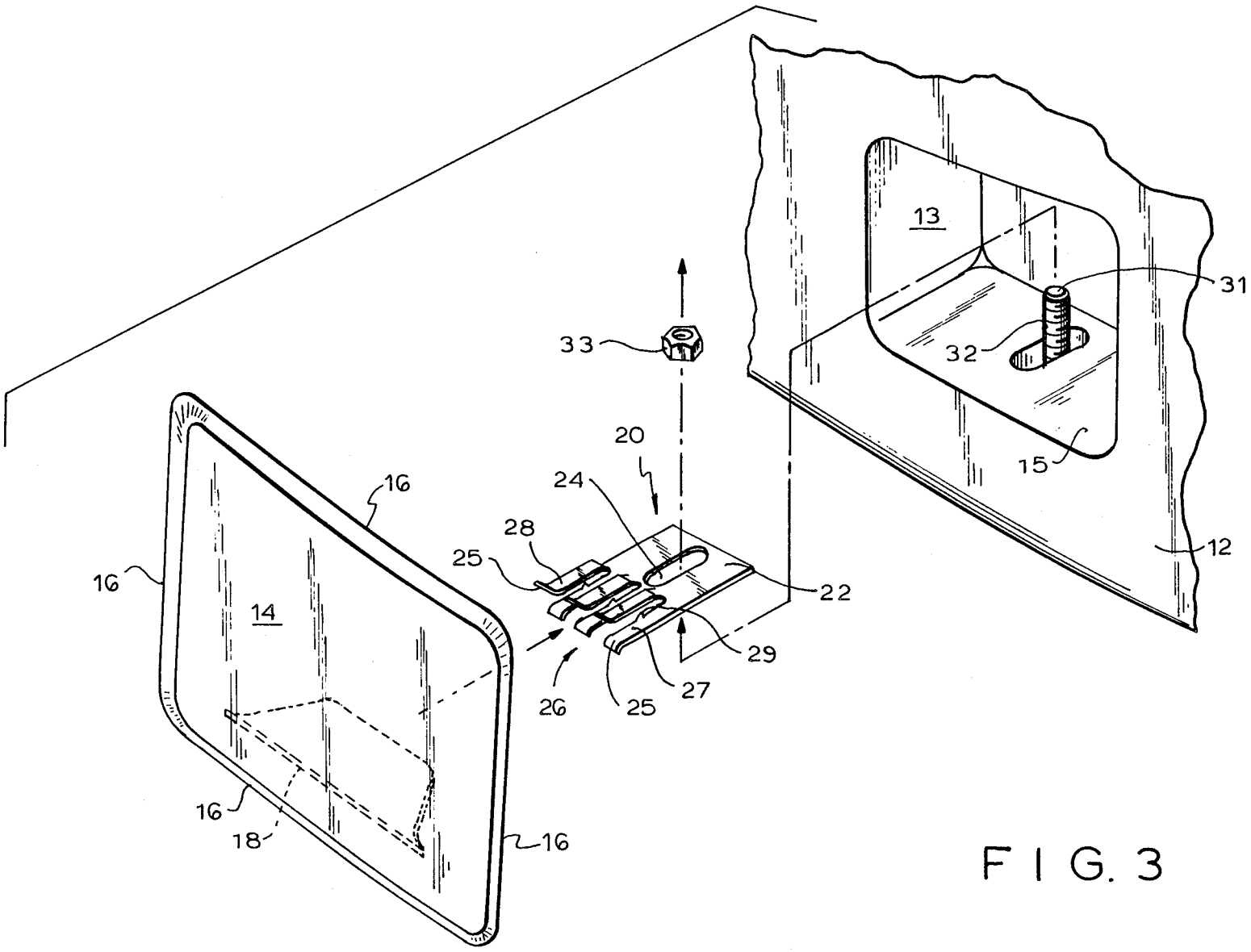
FIG. 3 is a view similar to FIG. 2 which illustrates the retainer clip and cover plate in exploded view.
Figure 4:
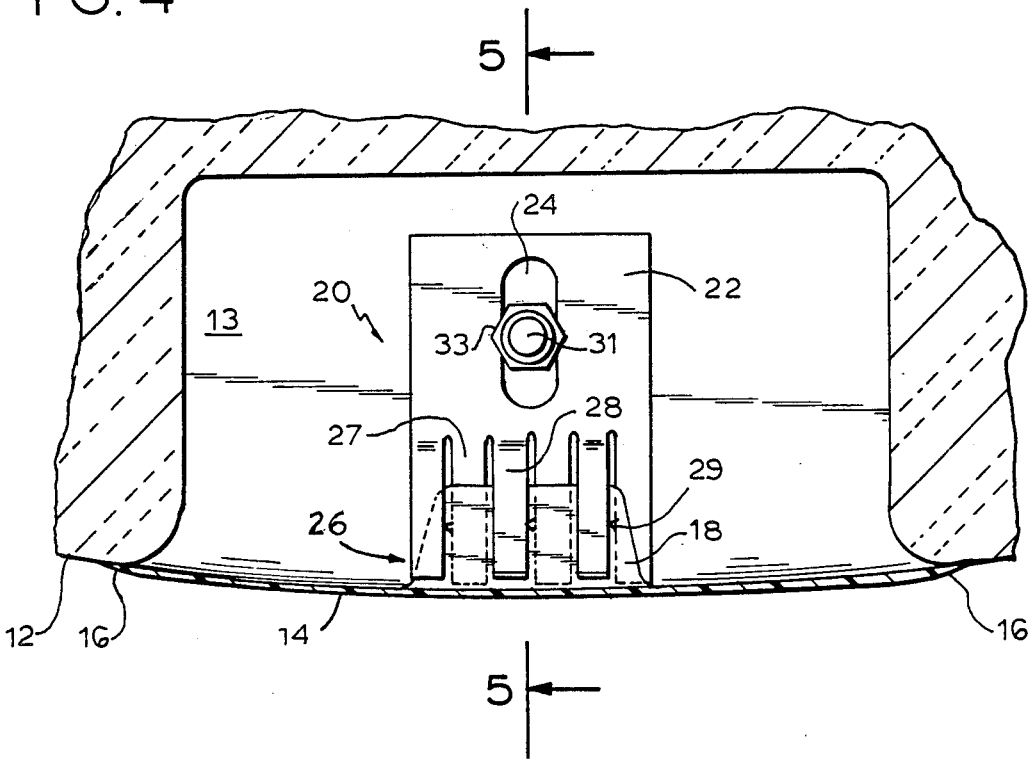
FIG. 4 is a fragmentary sectional view taken along the lines 4—4 of FIG. 1.
Figure 5:
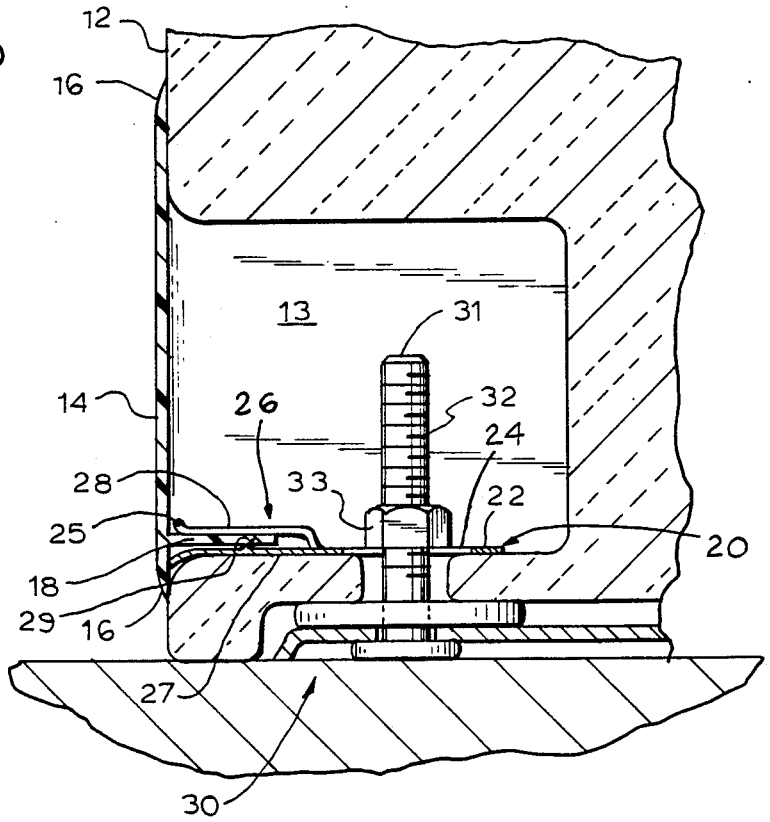
FIG. 5 is an elevational view taken along the lines 5—5 of FIG. 4.

Retainer clip 20 is formed having a plurality of parallel, longitudinally extending gripping fingers 26 and, as shown in FIG. 3, there are three coplanar and three offset fingers, and is the preferred form. At least two of the gripping fingers are coplanar 27 and are in spaced apart relation, and the other finger 28 is offset therefrom and positioned between the two spaced apart fingers to provide a space between the fingers substantially equal in height to the height of horizontal flange 18. Each finger 27 that is coplanar is struck to provide a projection 29 that extends obliquely upwardly and away from the end of finger 27. Also, the end section of each finger 27 is flanged obliquely outwardly to provide camming surfaces 25 to guide horizontal flange 18 into the space formed between flanges 27, 28. When cover plate 14 is mounted in position, horizontal flange 18 is inserted into the space between fingers 27, 28 so that projections 29 imbed into horizontal flange 18 to latch cover plate 14 in fixed position. The latching force is sufficient to deform cover plate 14 so that when it is in its latched position, cover plate 14 deforms and becomes generally coplanar with vertical wall 12 of sanitaryware 10. Perimeter 16 of cover plate 14 is tapered or feathered, which minimizes the accumulation of dust, dirt or the like, and facilitates cleaning of sanitary fixture 10.

The embodiment shown in FIGS. 6 through 8 illustrate a modified form of a retainer clip 20' having a flat body section 22' in which an elongated slot 24' is provided to adjust retainer clip 20' horizontally within the recess or opening 13 of sanitaryware 10. Extending from one end of retainer clip 20', are three gripping fingers 26', two fingers of which are coplanar, and each is struck with projections 29' in the same manner as provided in retainer clip 20. Also, the beveled forward ends of each finger are formed identical to the obliquely flanged, outwardly camming surfaces 25 of retainer clip 20. Only one finger 28' is spaced from the two coplanar fingers 27'. The preferred form shown in FIGS. 1 through 5 of clip 20 includes three coplanar fingers 27 and three spaced apart fingers 28. In both embodiments, clips 20 and 20' are formed of a metal. Cover plate 14 is preferably made of a plastic material which is flexible so that horizontal extending flange 18 is molded as a unit with cover plate 14.

What is claimed:

1. An assembly to conceal an opening which houses a mounting bolt of a sanitary fixture, said assembly comprising:

a cover plate and metal retainer clip;

said clip having a generally rectangular, flat body segment, one section of which is formed having an elongated longitudinal slot for receiving a shank of a threaded anchor bolt and another section formed having at least three parallel, horizontally extending gripping fingers, two of which are coplanar and are in spaced apart relation, said other finger being offset therefrom and positioned between said two spaced apart fingers;

said cover plate, formed of a flexible, deformable plastic material having its outer surface contoured to generally coincide with the outer surface of the sanitary fixture when mounted thereto;

said plate having a flange which extends horizontally away from the inner surface of said plate, said flange being aligned with said space formed between said gripping fingers of said clip, said gripping fingers having means releasably latching said horizontal flange to hold said plate in fixed position; and said latch means formed on said at least two gripping fingers, being in the form of a projection extending obliquely upwardly and away from the end of each finger so that when said horizontal flange of said cover plate is inserted between said gripping fingers, said projections are imbedded therein to latch said plate in fixed position.

2. The assembly according to claim 1 wherein said cover plate and horizontal flange are of unitary design.

3. The assembly according to claim 1 wherein said retainer clip is formed having six parallel, horizontally extending gripping fingers, three of which are in spaced apart relation and said three other gripping fingers are offset therefrom and positioned between said corresponding spaced apart fingers.

4. The assembly according to claim 1 wherein the end section of each of said fingers is flanged obliquely outwardly to provide camming surfaces to guide said horizontal flange of said cover plate between said fingers when inserted therebetween.

5. The assembly according to claim 1 wherein said latch means is formed on three gripping fingers.

* * * * *